US007753500B2

(12) United States Patent
Nishida

(10) Patent No.: US 7,753,500 B2
(45) Date of Patent: Jul. 13, 2010

(54) IMAGE FORMING APPARATUS

(75) Inventor: Hajime Nishida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 287 days.

(21) Appl. No.: 11/351,739

(22) Filed: Feb. 10, 2006

(65) Prior Publication Data

US 2006/0187288 A1 Aug. 24, 2006

(30) Foreign Application Priority Data

Feb. 22, 2005 (JP) ..... 2005-045709

(51) Int. Cl.

| | |
|---|---|
| ***B41J 2/17*** | (2006.01) |
| ***B41J 2/175*** | (2006.01) |
| ***B41J 2/01*** | (2006.01) |
| ***B41J 29/13*** | (2006.01) |
| ***B41J 2/165*** | (2006.01) |

(52) U.S. Cl. ..... 347/84; 347/29; 347/85; 347/86; 347/104; 347/108

(58) Field of Classification Search ..... 347/29, 347/30, 31, 32, 33, 22, 104, 84, 85, 108, 347/86

See application file for complete search history.

(56) References Cited

U.S. PATENT DOCUMENTS

| | | | | |
|---|---|---|---|---|
| 5,489,928 | A * | 2/1996 | Takahashi et al. | 347/45 |
| 5,963,237 | A * | 10/1999 | Ikkatai et al. | 347/85 |
| 6,040,670 | A * | 3/2000 | Kaneko et al. | 318/561 |
| 6,065,831 | A * | 5/2000 | Kawaura et al. | 347/108 |
| 6,293,649 | B1 * | 9/2001 | Norton | 347/37 |
| 6,299,299 | B1 * | 10/2001 | Fries et al. | 347/86 |
| 6,488,348 | B1 * | 12/2002 | Miura et al. | 347/6 |
| 6,945,714 | B2 * | 9/2005 | Miyauchi et al. | 400/55 |
| 7,194,219 | B2 * | 3/2007 | Sato et al. | 399/81 |
| 7,198,352 | B2 * | 4/2007 | Silverbrook | 347/42 |
| 7,290,849 | B2 * | 11/2007 | Yamazaki et al. | 347/19 |
| 2001/0026304 | A1 * | 10/2001 | Matsuzaki et al. | 347/85 |
| 2002/0041305 | A1 * | 4/2002 | Tsukuda | 347/35 |
| 2003/0206224 | A1 * | 11/2003 | Sakakibara et al. | 347/108 |

FOREIGN PATENT DOCUMENTS

| | | |
|---|---|---|
| JP | 7-266631 | 10/1995 |
| JP | 8-48058 | 2/1996 |
| JP | 10-147026 | 6/1998 |
| JP | 2001-121718 | 5/2001 |
| JP | 2002-361958 | 12/2002 |
| JP | 2003-94680 | 4/2003 |
| JP | 2004-181846 | 7/2004 |

OTHER PUBLICATIONS

Feb. 9, 2010 Japanese official action in connection with a counterpart Japanese patent application No. 2005-045709.

* cited by examiner

*Primary Examiner*—Stephen D Meier
*Assistant Examiner*—Leonard S Liang
(74) *Attorney, Agent, or Firm*—Cooper & Dunham LLP

(57) ABSTRACT

An image forming apparatus includes an engine unit formed by unitizing an engine part configured to scan a carriage having a recording head jetting a liquid drop of recording liquid in a main scanning direction and conveying a recording medium in a sub-scanning direction, so that an image is formed, and a keeping and recovering mechanism configured to keep an operating state of the recording head forming the engine unit, the keeping and recovering mechanism being provided at a rear side of an apparatus main body.

12 Claims, 9 Drawing Sheets

IMAGE FORMING APPARATUS

BACKGROUND

1. Technical Field

This disclosure generally relates to image forming apparatuses and more specifically to an image forming apparatus forming an image by a recording head configured to jet a liquid drop of recording liquid.

2. Description of the Related Art

Generally, an inkjet recording apparatus, for example, is known as an image forming apparatus such as a printer, facsimile, copier or a multiple function processing machine of the printer, facsimile, and copier. In the above-mentioned inkjet recording apparatus, while a recording medium is conveyed, a liquid drop of recording liquid (hereinafter "ink drop") is adhered to the recording medium by using a recording head having a liquid jet head configured to jet the liquid drop of the recording liquid, so that image forming such as recording or printing is performed. Hereinafter, the recording medium is called a paper or transferred material. However, there is no limitation of material for the paper or the transferred material.

Generally, a structure where a paper is fed from a back side and discharged to a front side is applied to such an image forming apparatus. For example, Japan Laid-Open Patent Application Publication No. 10-147026 discloses a structure where a carriage having a recording head is main-scanned in left and right directions of an apparatus main body, a recovery system unit is provided at a left side, and a main scanning motor and a sub-scanning motor are arranged in a right side.

In addition, a structure where ink is supplied from a side of the apparatus main body to the recording head provided at the carriage via an ink supply tube is disclosed in Japan Laid-Open Patent Application Publication No. 2004-181846.

A keeping and recovering mechanism of the recording head in an inkjet recording type image forming apparatus is disclosed in Japan Laid-Open Patent Application Publication No. 2003-94680 and others. Furthermore, a multi-function type image forming apparatus having inkjet recording type image forming means and electrophotographic type image forming means is disclosed in Japan Laid-Open Patent Application Publications No. 7-266631, No. 8-48058, and others.

In the meantime, a keeping and recovering mechanism for keeping and recovering a recording head jetting recording liquid is essential for the image forming apparatus configured to form an image by using the recording head formed by a liquid drop jet head. The keeping and recovering mechanism for keeping and recovering the recording head generally includes a moisture retention cap, a suction cap, a wiper blade, a test jet receiving member, and others. The moisture retention cap is configured to cap a nozzle surface and keep high sealability in order to prevent bodying and fixing of recording liquid (ink) in the vicinity of the nozzle due to natural evaporation of the recording liquid. The suction cap suctions the bodied recording liquid from the nozzle so as to discharge the recording liquid. The wiper blade wipes and removes the recording liquid adhered to the nozzle surfaces of the recording head. The test jet receiving member is used for test jetting that is jetting of liquid drops not contributing to recording (image forming). A driving source for raising and lowering the cap or the blade, operating the suction cap, or the like is necessary. Normally, a stepping motor is used as the driving source.

In a case where a serial scanning type wherein the image is formed on the paper while the recording head provided at the carriage is scanned in the main scanning direction is applied, the keeping and recovering mechanism is arranged at an end part side in the main scanning direction. Furthermore, in order to recover (ensure operation of) the nozzle during a recording process, the test jet receiving member is provided at the other end part side in the main scanning direction.

On the other hand, in a case where the image forming apparatus is formed as a multi-functional machine combining by an apparatus main body for forming an image, an image reading apparatus for reading a manuscript, and others, it is preferable to apply a front operation wherein an operation part for operating the apparatus is arranged at a front surface of the image forming apparatus. However, if the keeping and recovering mechanism discussed above is provided at the operation part side, noise generated by a keeping and recovering operation may be a problem for the user.

In addition, in a case where the carriage having the recording head and a sub-scanning conveyance part for conveying the recording medium is unitized so as to be detachable from the apparatus main body, attaching and detaching the unit to and from the apparatus main body should be easy to do.

In this case, where a sub-tank type, wherein the sub-tank is provided at the carriage together with the recording head and the recording liquid of the recording liquid cartridge at the apparatus main body side is supplied to the sub-tank via a tube, is applied, attaching and detaching the unit to and from the apparatus main body should be easy to do. In addition, a jam-clearing process should be easily performable without interference with the recording liquid tube.

BRIEF SUMMARY

In an aspect of this disclosure, an image forming apparatus is provided whereby noise at the time of a front operation can be reduced.

An image funning apparatus, in an exemplary embodiment of this disclosure, includes an engine unit formed by unitizing an engine part configured to scan a carriage having a recording head jetting a liquid drop of recording liquid in a main scanning direction and conveying a recording medium in a sub-scanning direction, so that an image is formed, and a keeping and recovering mechanism configured to keep an operating state of the recording head forming the engine unit, the keeping and recovering mechanism being provided at a rear side of an apparatus main body.

In the above-mentioned exemplary embodiment, noise generated during the operation of the keeping and recovering mechanism even during the front operation may not reach a user and noise at the time of a front operation can be reduced.

Other aspects, features, and advantages of the present invention will become more apparent from the following detailed description when read in conjunction with the accompanying drawings.

DETAILED DESCRIPTION OF THE PREFERRED EMBODIMENTS

A description of examples and exemplary embodiments of the present invention is now given, with reference to FIG. 1 through FIG. 9.

Figure 1:
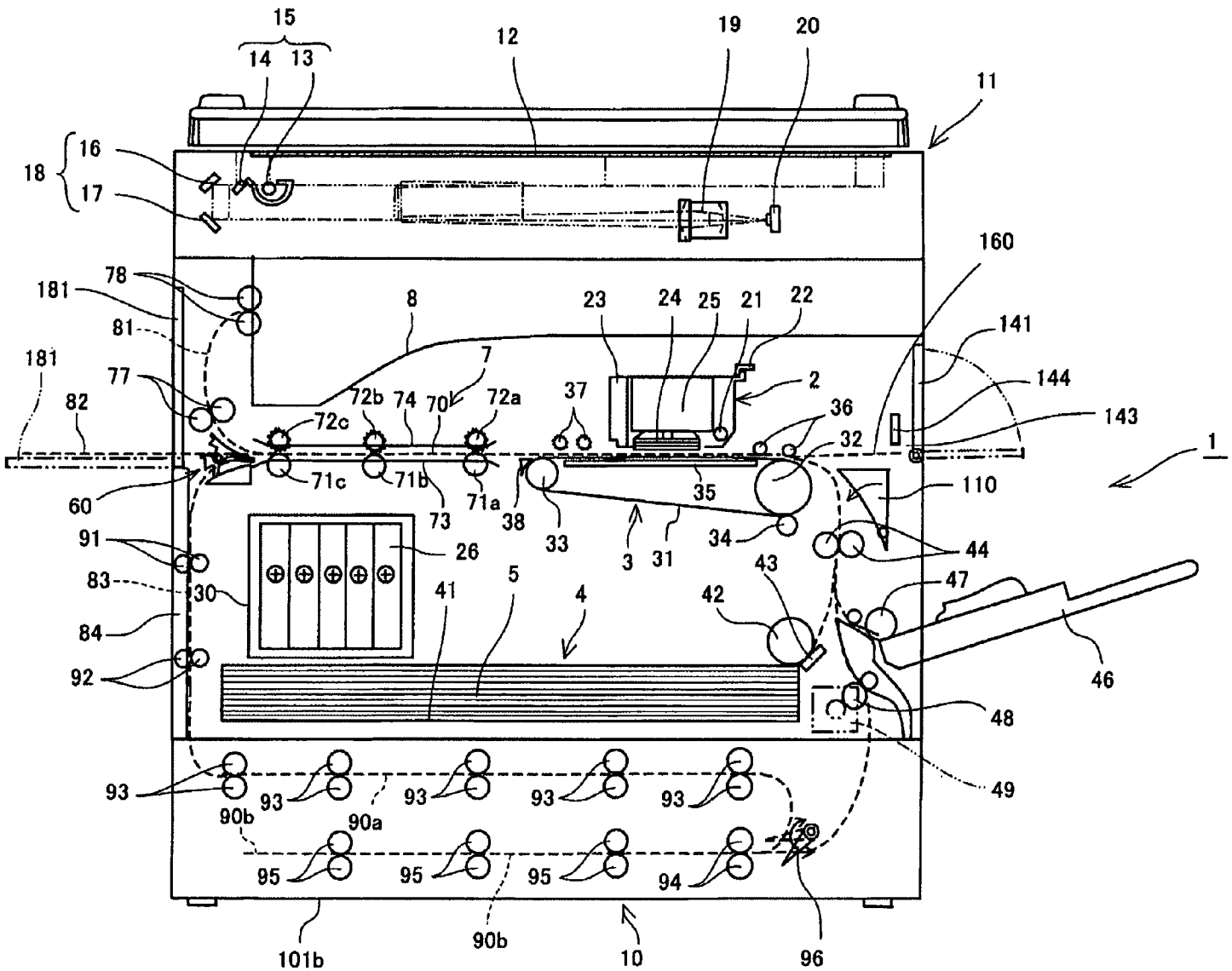
FIG. 1 is a schematic structural view showing a whole structure of an image forming apparatus of an embodiment of the present invention.
Figure 2:
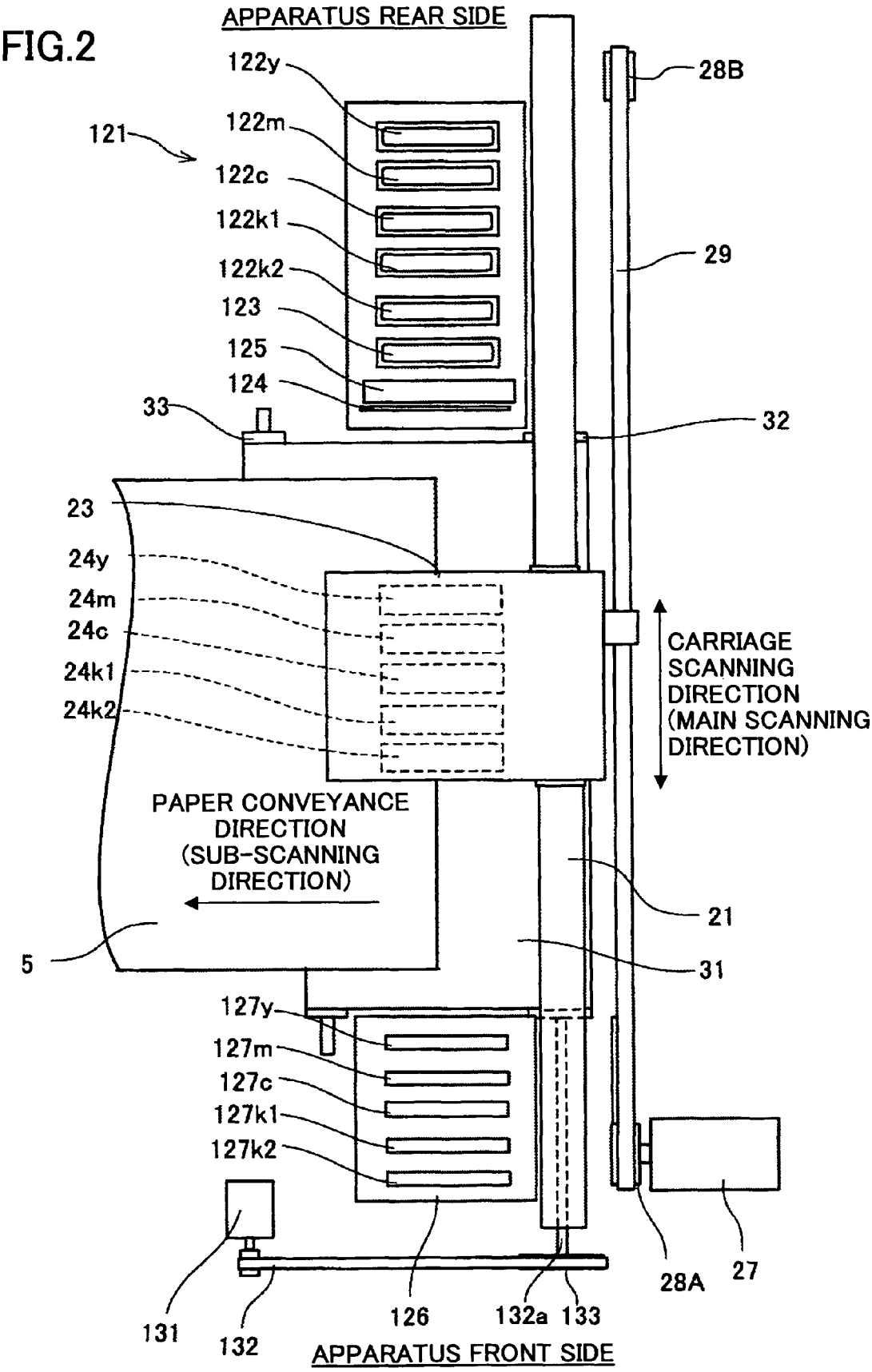
FIG. 2 is a plan view of an image forming part and a sub-scanning conveyance part of the image forming apparatus shown in FIG. 1.
Figure 3:
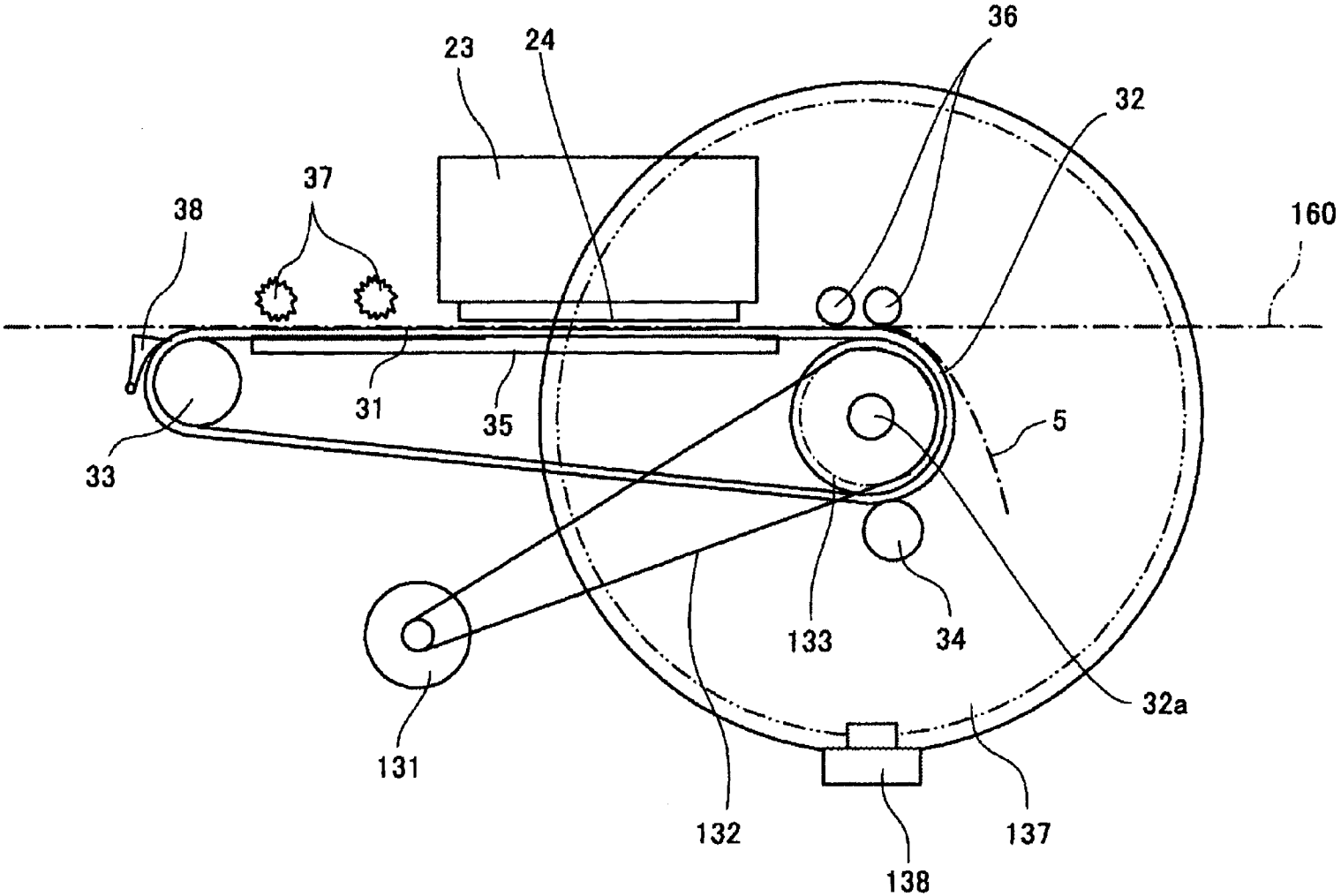
FIG. 3 is a front view of the sub-scanning conveyance part of the image forming apparatus shown in FIG. 1.

First, an embodiment of an image forming apparatus of the embodiment of the present invention is discussed with reference to FIG. 1 through FIG. 3. Here, FIG. 1 is a schematic structural view showing a whole structure of an image forming apparatus of an embodiment of the present invention, FIG. 2 is a plan view of an image forming part and a sub-scanning conveyance part of the image forming apparatus shown in FIG. 1, and FIG. 3 is a front view of the sub-scanning conveyance part.

The image forming apparatus has a structure where an image forming part (image forming means) 2 configured to form an image while a paper is conveyed, a sub-scanning conveyance part (sub-scanning conveyance means) 3 configured to convey the paper, and others are provided inside of an apparatus main body (housing) 1. Paper sheets 5 are fed one by one from a paper feeding part (paper feeding means) 4 including a paper feeding cassette provided at a bottom part of the apparatus main body 1. While the paper 5 is conveyed and at a position facing the image forming part 2 by the sub-scanning conveyance part 3, a liquid drop is jetted onto the paper 5 by the image forming part 2 so that an image is formed (recorded) on the paper 5. After that, in a case of one side printing, the paper 5 is discharged on a paper discharging tray 8 formed on an upper surface of the apparatus main body 1 via a paper discharge conveyance part (paper discharge conveyance means) 7. In a case of both sides printing, the paper 5 is sent from the paper discharge conveyance part 7 to a both sides unit 10 provided at the bottom part of the apparatus main body 1 so as to be switch-back conveyed (reversed), so that the paper 5 is fed to the sub-scanning conveyance part 3 again so that images are formed on both sides of the paper 5. After that, the paper 5 is discharged on the paper discharge tray 8.

As an input system of image data (printing data) formed by the image forming part 2, the image forming apparatus includes an image reading part (scanner part) 11 configured to read the image. The image reading part is provided at an upper part of the paper discharge tray 8 situated at an upper part of the apparatus main body 1. In the image reading part 11, a scanning optical system 15 that includes a lighting source 13 and a mirror 14 and a scanning optical system 18 that includes mirrors 16 and 17 are moved so that the image of a manuscript provided on a contact glass 12 is read out. A scanned manuscript image is read out as an image signal by an image reading element 20 provided at the back of a lens 19. The image signal that is read out is digitized and image-processed so that printing data that are image-processed can be printed.

This image forming apparatus has an input system of the image data (printing data) formed by the image forming part 2. The printing data and others including the image data from a host side such as an imaging apparatus like a digital camera, an image reading apparatus like an image scanner, an information processing apparatus like an outside personal computer, or the like can be received via a cable or network. The received printing data can be processed and printed.

As shown in FIG. 2, the image forming part 2 of the image forming apparatus has a structure where a carriage 23 is held movably in a main scanning direction in a cantilever state by a guide rod 21 and a guide rail 22. The carriage 23 can move in the main scanning direction driven by an endless timing belt 29 wound around and tensioned between a driving pulley 28A and an idler pulley 28B and driven by a main scanning motor 27.

A recording head 24 is mounted on the carriage 23. The recording head 24 is formed by a liquid drop jet head configured to jet a liquid drop of each color. The carriage 23 is moved in a main scanning direction. While the paper 5 is intermittently sent in a paper conveyance direction (sub-scanning direction) by the sub-scanning conveyance part 3, the liquid drops are jetted from the recording head 24 which is a shuttle type head so that the image is formed.

The recording head 24 includes two liquid drop jet heads 24*k*1 and 24*k*2 configured to jet black (Bk) ink, a liquid drop jet head 24*c* configured to jet cyan (C) ink, a liquid drop jet head 24*m* configured to jet magenta (M) ink, and a liquid drop jet head 24*y* configured to jet yellow (Y) ink. Color ink is supplied from respective sub tanks 25 provided in the carriage 23.

On the other hand, as shown in FIG. 1, ink cartridges 26 of respective colors can be detachably arranged from a front surface of the apparatus main body 1 into a cartridge arranging part 30. Black (Bk) ink, cyan (C) ink, magenta (M) ink, and yellow (Y) ink are received in the ink cartridges 26. Inks are supplied from the ink cartridges 26 to the corresponding sub tanks 25. The black (Bk) ink is supplied from a single ink cartridge 26 to two sub tanks 25.

As the recording head 24, a piezoelectric type recording head, a thermal type recording head, an electrostatic type recording head, and others can be used. In a case of the piezoelectric type recording head, a piezoelectric element is used as pressure generation means (actuator means) for putting ink under pressure in an ink path (pressure generation room) and a vibration plate forming a wall surface of the ink path is deformed so that the volume of the ink path is changed and the ink drop is jetted. In a case of the thermal type recording head, the ink drop is jetted by pressure based bubbles generated by heating the ink in the ink path by using a heat-generating resistance body. In a case of an electrostatic type recording head, a vibration plate forming a wall surface of an ink path and an electrode face each other and the vibration plate is deformed by an electrostatic force generated between the vibration plate and the electrode so that the volume of the ink path is changed and the ink drop is jetted.

In a non-printing area at one side in a main scanning direction of the carriage 23, as shown in FIG. 2, a keeping and recovering apparatus 121 configured to restore and maintain an operable state of the nozzle of the recording head 24 is provided. The keeping and recovering apparatus 121 includes five moisture retention caps 122*k*2, 122*k*1, 122*c*, 122*m*, and 122*y*, a single suction cap 123, a wiper blade 124, a test jet receiving member 125, and others. The moisture retention caps 122 are configured to cap the nozzle surfaces of the recording heads 24. The wiper blade 124 is configured to wipe the nozzle surfaces of the recording heads 24. The test jet receiving member 125 is used for test jetting that is jetting of the liquid drops not contributing to recording (image forming).

Furthermore, in a non-printing area at another side in the main scanning direction of the carriage 23, as shown in FIG. 2, a test jet receiving member 126 is provided. The test jet receiving member 126 is used for test jetting that is jetting of the liquid drops not contributing to recording (image forming) from five recording heads 24. As corresponding to the recording head 24, five openings 127*k*2, 127*k*1, 127*c*, 127*m*, and 127*y* are formed in the test jet receiving member 126.

As shown in FIG. 3, the sub-scanning conveyance part 3 includes an endless conveyance belt 31, an electrostatic charging roller 34, a guide member 35, two pressing rollers 36, two rollers 37, and a separation claw 38. The endless conveyance belt 31 is wound around a conveyance roller 32 which is a driving roller and an idler roller 33 which is a tension roller so that the conveyance direction of the paper 5 fed from a lower part is changed by about 90 degrees and the paper 5 is conveyed so as to face the image forming part 2. The electrostatic charging roller 34 is an electrostatic charging part configured to apply a high voltage that is an AC (alternating current) voltage from a high voltage electric power source so that a surface of the conveyance belt 31 is charged. The guide member 35 guides the conveyance belt 31 in an area facing the image forming part 2. The pressing roller 36 presses the paper 5 to the conveyance belt 31 at a position facing the conveyance roller 32. The roller 37 presses at an upper side of the paper 5 where the image is formed by the image forming part 2. The separation claw 38 is configured to separate the paper 5 where the image is formed from the conveyance belt 31.

The conveyance roller 32 is rotated by the sub-scanning motor 131 via a timing belt 132 and a timing roller 133, so that the conveyance belt 31 of the sub-scanning conveyance part 3 goes around in a paper conveyance direction, namely a sub-scanning direction, in FIG. 2.

The conveyance belt 31 has a double-layer structure of a surface layer and a rear surface layer. The surface layer is a paper attraction surface formed by, for example, a pure resin material where resistance control is not applied such as ETFE pure material. The rear surface layer (middle resistance layer, earth layer), where the resistance control is applied by carbon, is formed by the same material as the surface layer. However, the structure of the conveyance belt 31 is not limited the double-layer structure but may be a single layer structure or triple or more layer structure.

A linear scale, not shown in FIG. 3, is formed on a surface at a rear surface side of the conveyance belt 31, namely the surface coming in contact with an external circumferential surface of the conveyance roller 32. A refection type photo sensor 138 is provided so as to read the linear scale. The linear scale and the photo sensor 138 form a linear encoder.

The paper feeding part 4 includes a paper feeding cassette 41, a paper feeding roller 42, a friction pad 43, and resist rollers 44. The paper feeding cassette 41 is provided detachably from the front surface side of the apparatus main body 1 and holds a large number of the papers 5. The paper feeding roller 42 separates and sends the papers 5 provided in the paper feeding cassette 41 one by one. The fed paper 5 is restrained by the resist rollers 44.

The paper feeding part 4 also includes a manual tray 46, a manual roller 47, and a conveyance roller 48. The manual tray 46 also holds a large number of the papers 5. The manual roller 47 feeds the papers 5 one by one from the manual tray 46. The conveyance roller 48 conveys the paper 5 fed from the paper feeding cassette optionally provided at a lower side of the apparatus main body 1 or the both-sides unit 10 discussed below. Members configured to feed the paper to the sub-scanning conveyance part 3 such as the paper feeding roller 42, the resist rollers 44, the manual roller 47, and the conveyance roller 48 are driven and rotated by the paper feeding motor 49 such as an HB type stepping motor via an electromagnetic clutch not shown.

The paper discharge conveyance part 7 includes conveyance rollers 71*a*, 71*b*, and 71*c*, rollers 72*a*, 72*b* and 72*c*, a lower guide 73, an upper guide 74, a turning-over roller couple 77, and a turning-over paper discharge roller couple 78. The conveyance rollers 71*a*, 71*b*, and 71*c* convey the paper 5 separated by the separation claw 38 of the sub-scanning conveyance part 3. The rollers 72*a*, 72*b*, and 72*c* face the conveyance rollers 71*a*, 71*b*, and 71*c*. The lower guide part 73 and the upper guide part 74 guide the paper 5 conveyed between the paper discharge roller 71 and the rollers 72. A conveyance path through which the paper 5 is conveyed between the lower guide part 73 and the upper guide part 74 is called a conveyance path 70. The conveyance path 70 has a length whereby the time for drying is adequate even if the image on the paper 5 is rubbed when the paper 5 is turned over and discharged. The paper 5 between the lower guide part 73 and the upper guide part 74 is turned over via the turning-over paper discharge path 81 as a first conveyance path so that the paper 5 is sent to the paper discharge 8 face-down by the turning-over roller couple 77 and the turning-over paper discharge roller couple 78.

A branching mechanism 60 is provided at an exit side of the conveyance path 70 so that the conveyance path is switched to the first paper discharge path 81 for turning over and discharging the paper 5 to the paper discharge tray 8, the second paper discharge path 82 for discharging the paper to a straight paper discharge tray 181, or the both sides unit 10.

A vertical both sides conveyance path 83 is provided on the side surface of the apparatus main body 1 so that the paper 5 branched by the branching mechanism 60 is conveyed downward so as to be sent to the both sides unit 10. An entrance roller couple 91 and an exit roller couple 92 are provided at the vertical both sides conveyance path 83 so that the sent paper 5 is conveyed downward. In addition, a guide plate 84 is provided at a side part of the apparatus main body 1 so that the vertical both sides conveyance path 83 is formed.

The both-sides unit 10 includes a horizontal taking conveyance 90*a* through which the paper 5 sent from the vertical both sides conveyance path 83 is conveyed in a horizontal direction, and a switch back conveyance path 90*b*. Five both-sides conveyance roller couples 93 are provided at the horizontal talking conveyance path 90*a*. Three both-sides conveyance roller couples 95 and a both sides exit roller 94 formed by a reverse roller for turning over and re-feeding the paper 5 send through the horizontal talking conveyance path 90*a* are provided at the switch back conveyance path 90*b*.

A branching plate 96 is provided to oscillate so that the conveyance path from the taking conveyance 90*a* to the switch back conveyance 90*b* and the conveyance path for re-feeding from the switch pack conveyance 90*b* to the conveyance roller 48 can be switched. The branching plate 96 can be oscillated between a switch back side position shown by a solid line in FIG. 1 and a re-feeding side position shown by a broken line in FIG. 1.

The paper 5 sent from the both sides unit 10 is sent to the resist rollers 44 via the conveyance roller 48.

As shown in FIG. 1, an opening and closing guide plate 110 is provided to oscillate so that a back force due to the weight of the paper 5 is prevented by forming a curve in the paper 5 between the conveyance roller 32 and the pressing roller 36 and the resist rollers 44 when the paper 5 fed from the paper feeding cassette 41, the manual paper feeding tray 46, or the both sides unit 10 is conveyed by the resist rollers 44.

When the paper 5 is sent from the resist rollers 44 to the sub-scanning conveyance part 3, the opening and closing guide plate 110 is oscillated in a direction shown by an arrow in FIG. 1 for guiding the paper 5. At the timing when the paper 5 reaches the sub-scanning conveyance part 3, the opening and closing guide plate 110 returns to the position shown in FIG. 1 so that the curve can be formed.

In addition, in this image forming apparatus, as shown in FIG. 1, a single paper manual paper feeding tray 141 is provided for single paper manual paper feeding. The single paper manual paper feeding tray 141 is provided at one side part of the apparatus main body 1 so as to be able to be opened and closed. When single paper manual paper feeding is performed, the single paper manual paper feeding tray 141 is opened at a position shown by a horizontal 2-dot broken line. The paper 5 which is manually fed from the single paper manual paper feeding tray 141 is guided by an upper surface of the opening and closing guide plate 110 so that the paper 5 can be linearly pushed between the conveyance roller 32 and the pressing roller 36.

On the other hand, the straight paper discharge tray 181 is provided at the opposite side part of the apparatus main body 1 so as to be able to open and close in order to discharge the paper 5 where the image is formed facing up. By opening the straight paper discharge tray 181, a straight paper discharge path 82 as a second paper discharge path is formed so that the paper 5 sent from the lower guide part 73 and the upper guide part 74 is discharged to the paper discharge conveyance part 7 straight out horizontally.

Under this structure, if a paper, such as an OHP or a paper with greater thickness, whose curving conveyance is difficult, is used, single paper manual paper feeding is performed from the single paper manual paper feeding tray 141 so that the paper 5 can be conveyed to the straight paper discharge tray 181 along a straight path. Even if the paper is has normal thickness, it is possible to feed the paper from the single paper manual paper feeding tray 141 and discharge the paper to the straight paper discharge tray 181 along the straight path.

An operation for image forming in this image forming apparatus is discussed. By applying a high voltage of a rectangular wave, which is an AC voltage from an AC bias supply part, via positive and negative electrodes to an electrostatic charge roller 34, positive and negative electrical charges are reciprocally applied to the surface layer of the conveyance belt 31 in a belt shape against the conveyance direction of the conveyance belt 31 because the electrostatic charge roller 34 comes in contact with the insulation layer (surface layer) of the conveyance belt 31. As a result of this, unequal electrical fields are generated due to electric charges being generated on the conveyance belt 31 at a designated charge width.

In a case where the paper 5 is fed from the paper feeding part 4, the manual paper feeding part 46, the both-sides unit 10, or the single paper manual paper feeding tray 141 and the electric charge of the positive and negative electrodes is formed between the conveyance roller 32 and the pressing roller 36 so that the paper 5 is sent to the conveyance belt 31 where unequal electric fields are generated, the paper 5 is immediately polarized as following the direction of the electric fields. As a result of this, the paper 5 is adhered on the conveyance belt 31 by an electrostatic attraction force so as to be conveyed by the movement of the conveyance belt 31.

While the paper 5 is conveyed intermittently by the conveyance belt 31, the liquid drops are jetted from the recording head 24 onto the paper 5 as corresponding to the printing data so that the image is formed (printed). A head end side of the paper 5 where the image is formed is separated from the conveyance belt 31 by the separation claw 38. Then the paper 5 is discharged to the paper discharge tray 8 or the straight paper discharge tray 18 by the paper discharge conveyance part 7, or sent to the both sides unit 10 and then discharged after an image is formed on the other side.

Figure 4:
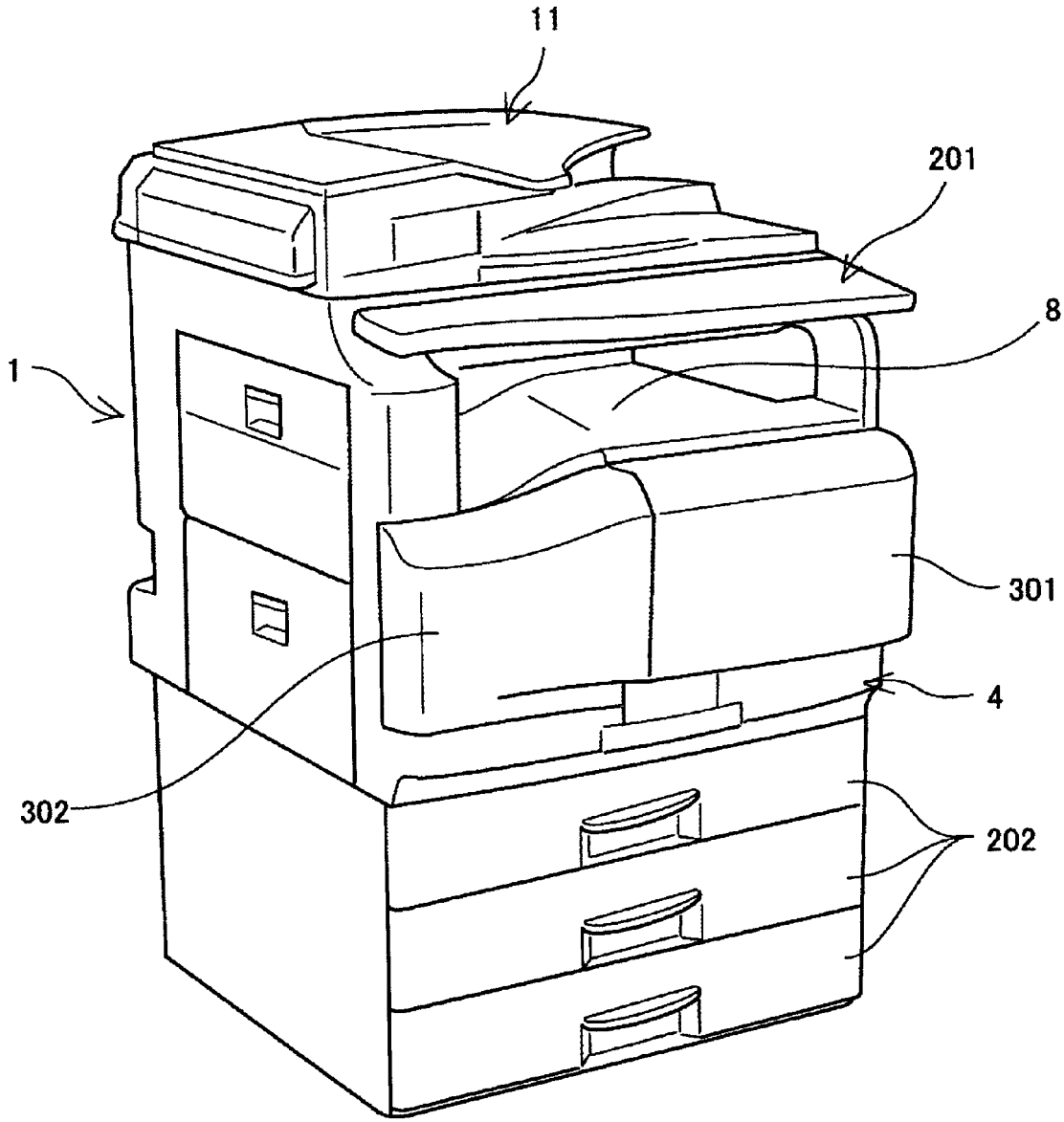
FIG. 4 is an exterior appearance perspective view of the image forming apparatus shown in FIG. 1.
Figure 5:
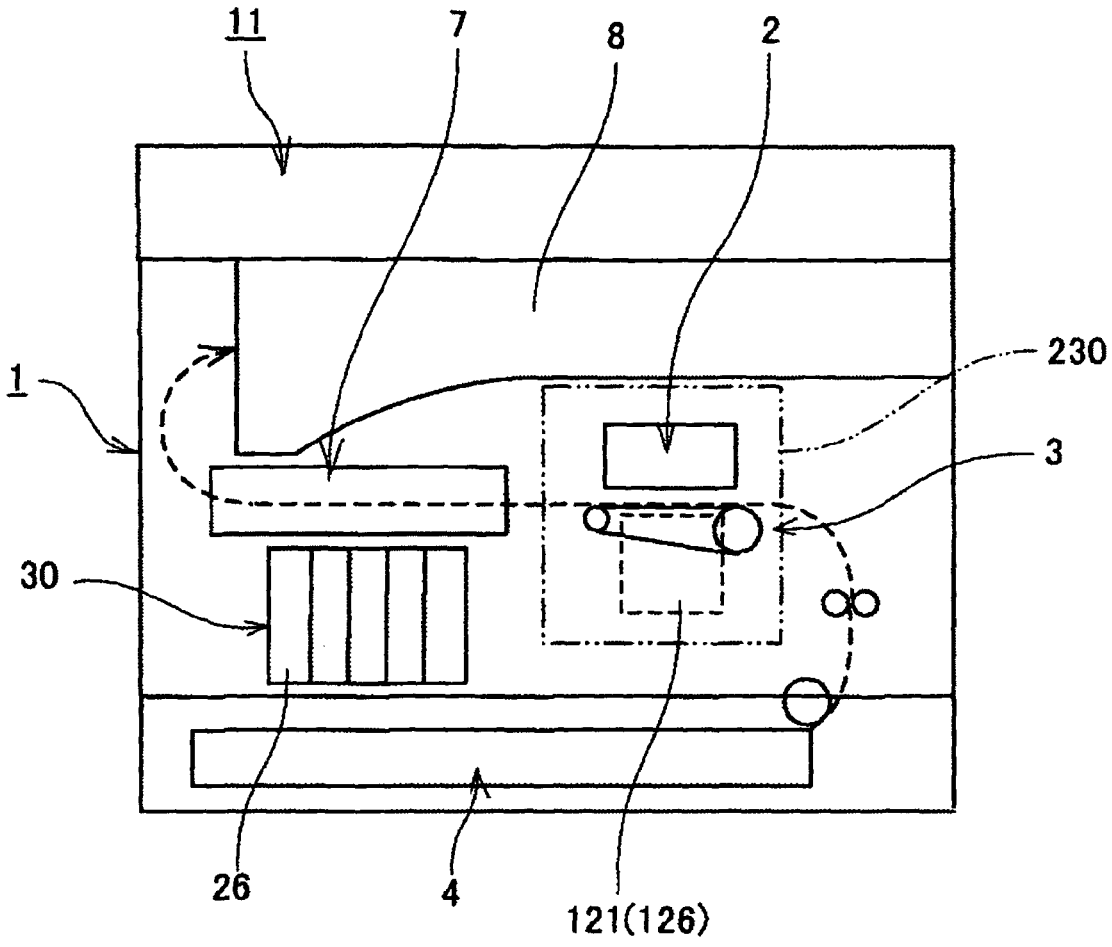
FIG. 5 is a schematic front view of an apparatus main body 1 of the image forming apparatus.
Figure 6:
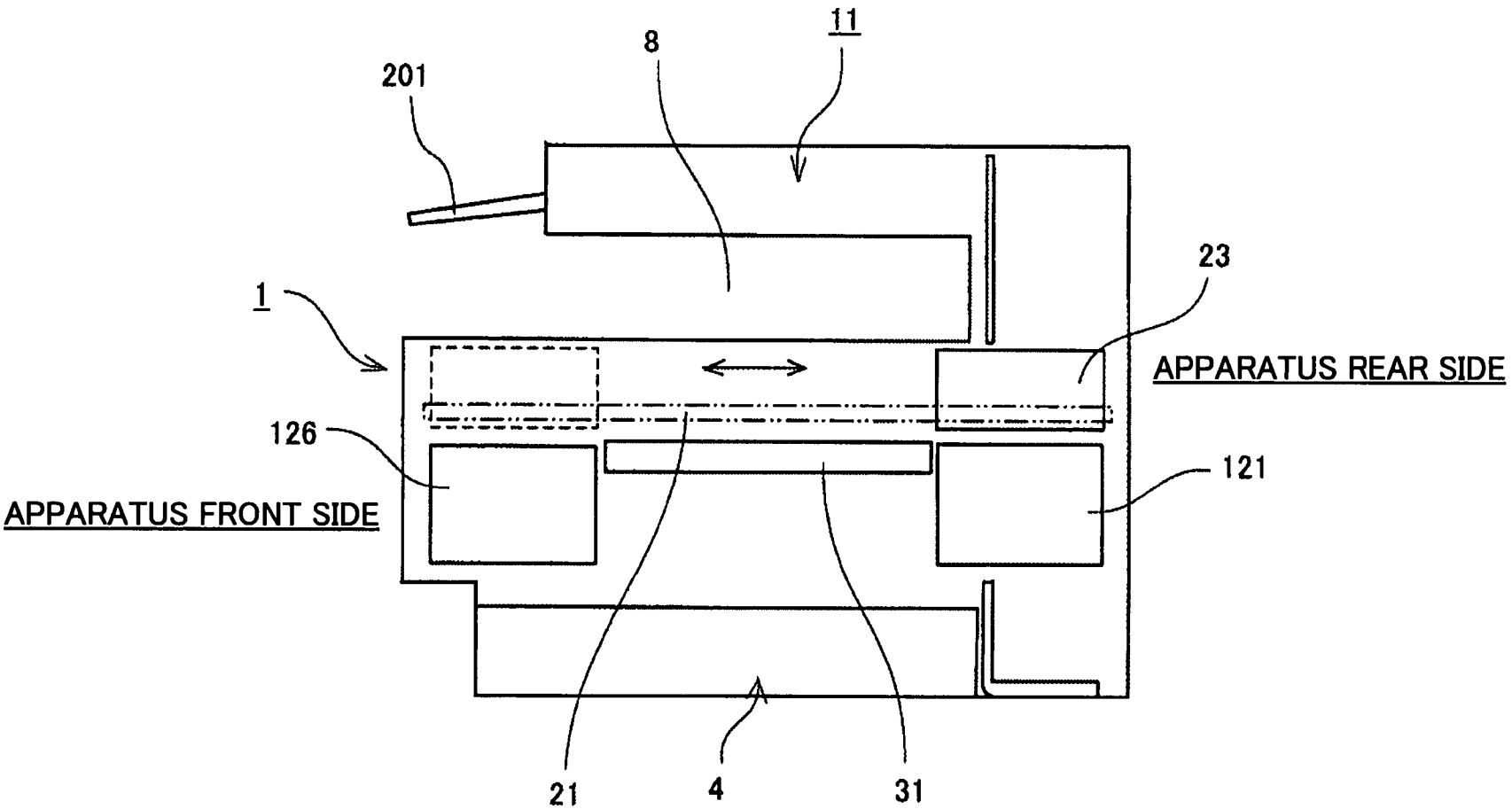
FIG. 6 is a schematic right side view of the apparatus main body 1 of the image forming apparatus.

Next, arrangement of the parts of this image forming apparatus is discussed with reference to FIG. 4 through FIG. 8. Here, FIG. 4 is an exterior appearance perspective view of the image forming apparatus shown in FIG. 1, FIG. 5 is a schematic front view of an apparatus main body 1 of the image forming apparatus, FIG. 6 is a schematic right side view of the apparatus main body 1 of the image forming apparatus, FIG. 7 is a schematic plan view of the apparatus main body 1 of the image forming apparatus, and FIG. 8 is a perspective view of an engine unit.

Figure 8:
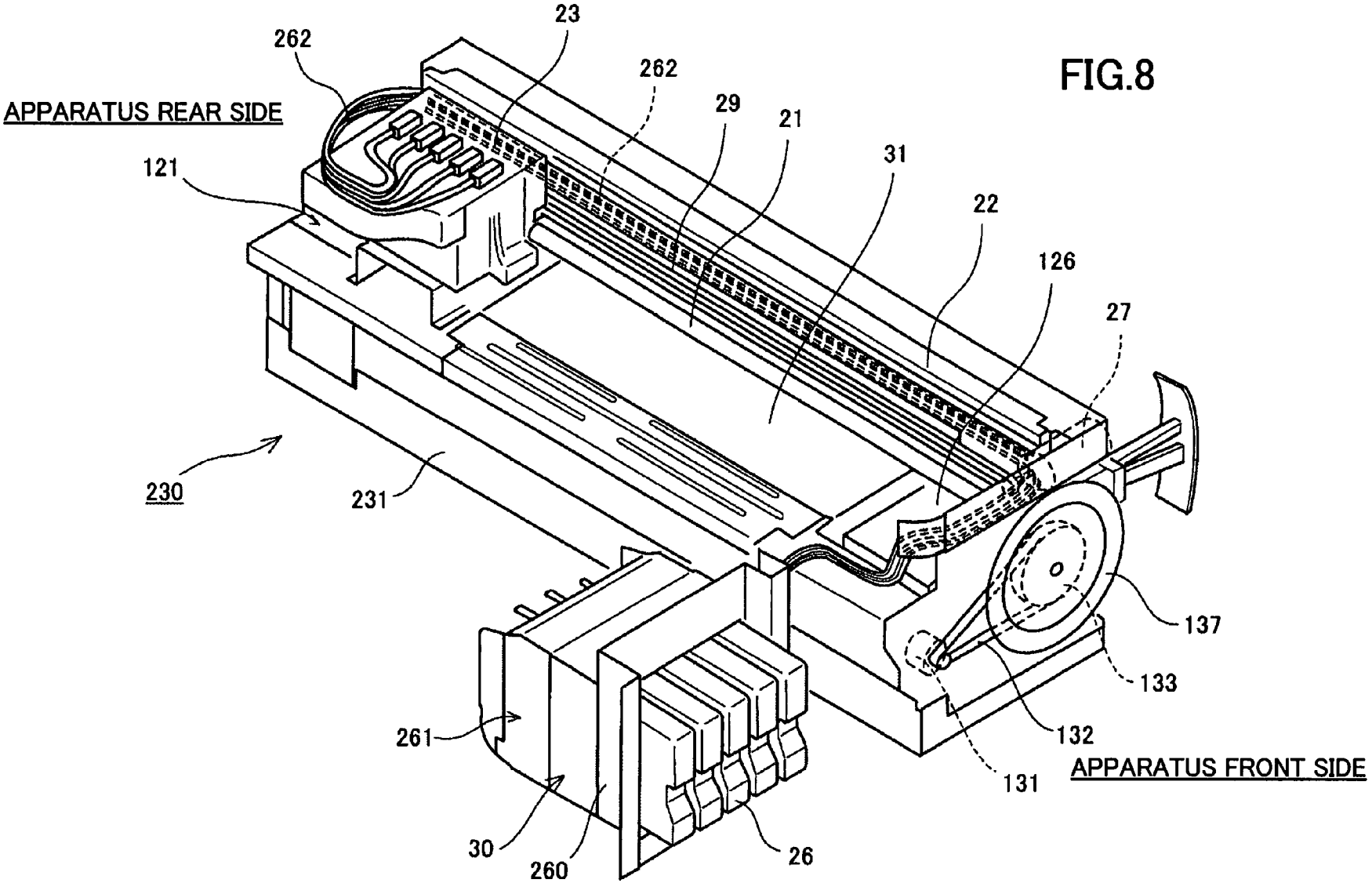
FIG. 8 is a perspective view of an engine unit.

In this image forming apparatus, the image forming part 2 and the sub-scanning conveyance part 3 are unitized so that an engine unit (engine part) 230 as shown in FIG. 8 is formed. The engine unit 230, the paper feeding part 4 and the paper discharge conveyance part 7 are provided in the apparatus main body 1 (See FIG. 5). An image reading part 11 is arranged on the apparatus main body 1. A paper discharge part (paper discharge tray) 8 configured to discharge the paper is provided at an upper part of the apparatus main body 1. Above the paper discharge tray 8 and at a front side of the apparatus main body 1, an operation part (operations panel) 201 is provided in an oscillating manner as a tilt type so that a front operation type is formed. By the operation part 201, a designated instruction is given to the apparatus main body 1 and the image reading part 11 and designated information is displayed. Furthermore, in this image forming apparatus, plural extension paper feeding trays 202 for receiving papers, instead of the above-mentioned both sides unit 10, are stuck at a lower part of the apparatus main body 1.

In addition, a right front cover 301 and a left front cover 302 are provided at the front surface side of the apparatus main body 1. The right front cover 301 can be opened and closed so that the engine unit 230 unitized by the image forming part 2 and the sub-scanning conveyance part 3 is detachably installed in the apparatus main body 1. The left front cover 302 can be opened and closed so that the ink cartridge 26 can be exchanged from within the cartridge arranging part 30.

Figure 7:
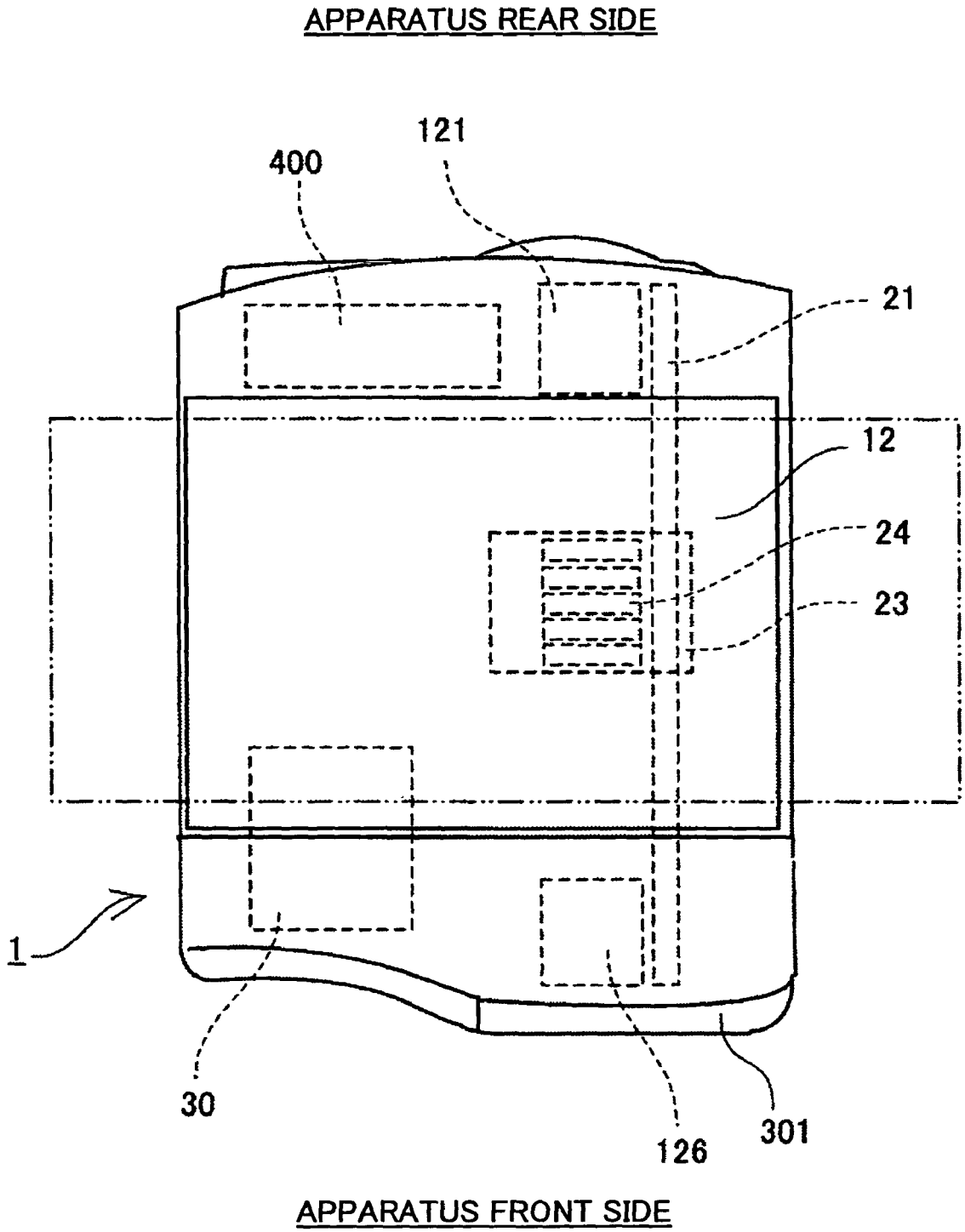
FIG. 7 is a schematic plan view of the apparatus main body 1 of the image forming apparatus.

As shown in FIG. 7 being a schematic plan view of the apparatus main body 1 of the image forming apparatus, the right front cover corresponding to the test receiving member 126 (See FIG. 2) of the engine unit 230 has a relatively projecting configuration and the left front cover 302 corresponding to the cartridge arranging part 30 has a relatively recessed configuration. Because of this structure, it is possible to make the space occupied by the apparatus main body 1 in a plane configuration.

The engine unit 230 is provided at a right side (at left side seen from an opposite side) in the apparatus main body 1. The paper discharge conveyance part 7 is provided at a side of the engine unit 230. The paper discharge conveyance part 7 includes the paper discharge path 70 through which the paper 5 where the image is formed by this engine unit 230 is linearly conveyed. In addition, the ink cartridge arranging part 30 where the ink cartridge 26 as a recording liquid cartridge is detachably arranged is provided at a lower part of the paper discharge conveyance part 7.

Thus, since the paper discharge path 70 through which the paper 5 where the image is formed by this engine unit 230 is linearly conveyed is provided, it is possible to have a time for drying the recording liquid adhered on the paper 5 where the image is formed, and the paper 5 is discharged to the paper discharge tray 8 after being dried. Accordingly, it is possible to prevent degradation of image quality due to rubbing of the image surface.

In a case where a paper just after the image is formed on the paper is immediately reverse-discharged, in order to reverse the paper, an image forming surface has to be supported by a roller before the recording liquid on the paper is sufficiently dried. Therefore, rubbing of the image surface may be easily generated so that the image quality may be degraded.

On the other hand, in this embodiment, the paper discharge part 7 configured to linearly convey the paper 5 just after the image is formed by this engine unit 230 in a state where the image forming surface faces up is provided. Therefore, it is possible to secure a time for drying the recording liquid adhered on the paper 5 where the image is formed. Hence, even if the paper 5 is reversed after that, damage due to rubbing of the image surface is not generated. Accordingly, it is possible to prevent degradation of image quality.

In addition, in this embodiment, the ink cartridge arranging part 30 where the ink cartridge 26 is arranged is provided at the lower part of the paper discharge conveyance part 7. Hence, it is possible to effectively use the space, and the occupied space in a depth direction of the apparatus main body 1 can be made small.

In other words, since the keeping and recovering mechanism 121 configured to keep and recover the recording head 24 and the test jet receiving member 126 are necessary in the serial scan type image forming part, the scanning area of the carriage 23 is wider than the width of a paper which can be transferred. Because of this, in a structure where the carriage 23 is scanned in front and rear directions of the apparatus main body 1, for example, the keeping and recovering mechanism 121 is arranged at a read side and the test jet receiving member 126 is arranged at a front side.

In a case where an image forming apparatus has a structure where an ink tank (ink cartridge) is provided in the carriage 23, it is not necessary to separately provide an arranging part, where the ink cartridge is arranged, at the side of the apparatus main body 1. However, in a structure of a sub-tank type such as the image forming apparatus of this embodiment, it is necessary to provide the arranging part, where the ink cartridge is arranged, at the side of the apparatus main body 1.

If this ink cartridge arranging part 30 is provided at a lower part of the engine unit 230, the height of the apparatus main body 1 is unnecessarily too high in a structure where the keeping and recovering mechanism 121 or the test jet receiving member 126 are arranged at both sides in the main scanning direction of the carriage. In addition, in a case of structure, like the image forming apparatus of this embodiment, where the engine unit 230 is detachable from the apparatus main body 1, the ink cartridge arranging part 30 cannot be arranged at a front side of the engine unit 230.

Accordingly, as shown in FIG. 5, which FIG. 5 is a schematic front view of an apparatus main body 1 of the image forming apparatus, the ink cartridge arranging part 30 is arranged in a space of the lower part of the paper discharge part 7 and at a side part of the engine unit 230, so that the ink cartridge arranging part 30 can be arranged without making the height and width of the apparatus main body 1 large. In addition, as shown in FIG. 7, which FIG. 7 is a schematic plan view of the apparatus main body 1 of the image forming apparatus, the ink cartridge arranging part 30 is provided at an inside of a maximum paper transferring width, so that the occupied space in the front and rear directions of the apparatus main body 1 can be made small. In a case where the paper discharging conveyance part 7 for having a time for drying the recording liquid adhered on the paper is provided, the space at lower part of the paper discharge conveyance part 7 can be effectively used.

Furthermore, in the image forming apparatus of this embodiment, as shown in FIG. 7 and FIG. 5, the ink cartridge arranging part 30 is arranged at the front surface side of the apparatus main body 1 and an electric equipment part 400 is arranged at rear side facing the ink cartridge arranging part 30 of the apparatus main body 1. The electric equipment part 400 includes parts causing heat generation.

That is, heat generation from the electric equipment part 400 which equipment part 400 contains an electric power source or a control board cannot be avoided. If such an electric equipment part 400 is arranged at a lower part of the keeping and recovering mechanism 121 of the image forming part 2 using the recording liquid, temperature of the keeping and recovering mechanism 121 or the recording head 24 is increased by the heat rising from the electric equipment part 400. This promotes drying of the recording liquid and clogging of the recording head 24 may be easily generated.

Because of this, in the image forming apparatus of this embodiment, in order to effectively use a space formed by arranging the keeping and recovering mechanism 121 and the test jet receiving member 126 at both side in the main scanning direction in shuttle type and in order to prevent the heat influence on the keeping and recovering mechanism 121 of the image forming part 2, the electric equipment part 400 including the parts causing heat generation is arranged at a side part of the keeping and recovering mechanism 121 and the rear side facing the ink cartridge part 30 of the apparatus main body 1. In this case, it is preferable that the electric equipment part 400 include, at least, the electric power source or the control board which may easily generate heat.

Next, the engine unit 230 is discussed with reference to FIG. 9 as well as FIG. 8. Here, FIG. 9 is a perspective view of the ink supply system of the engine unit 230.

This engine unit 230 is, as discussed above, formed by unitizing the image forming part 2 and the sub-scanning conveyance part 3. The engine unit is provided detachably from the apparatus main body 1 and thereby maintenance ability is improved.

Here, as discussed above, in a shuttle type, it is necessary to arrange the keeping and recovering mechanism 121 and the test jet receiving member 126 at both side in the main scanning direction. On the other hand, in a case of the front operation type wherein the paper is conveyed in a horizontal direction seen from the operator, a main scanning direction of the carriage 23 is a front and rear direction of the apparatus main body 1 as shown in FIG. 6. In this case, a driving source such as a stepping motor for operating the cap 122, the blade 124, a suction cap (not shown), and others is necessary for the keeping and recovering mechanism 121. Especially, if the stepping motor is used as the driving source, noise is generated.

Figure 9:
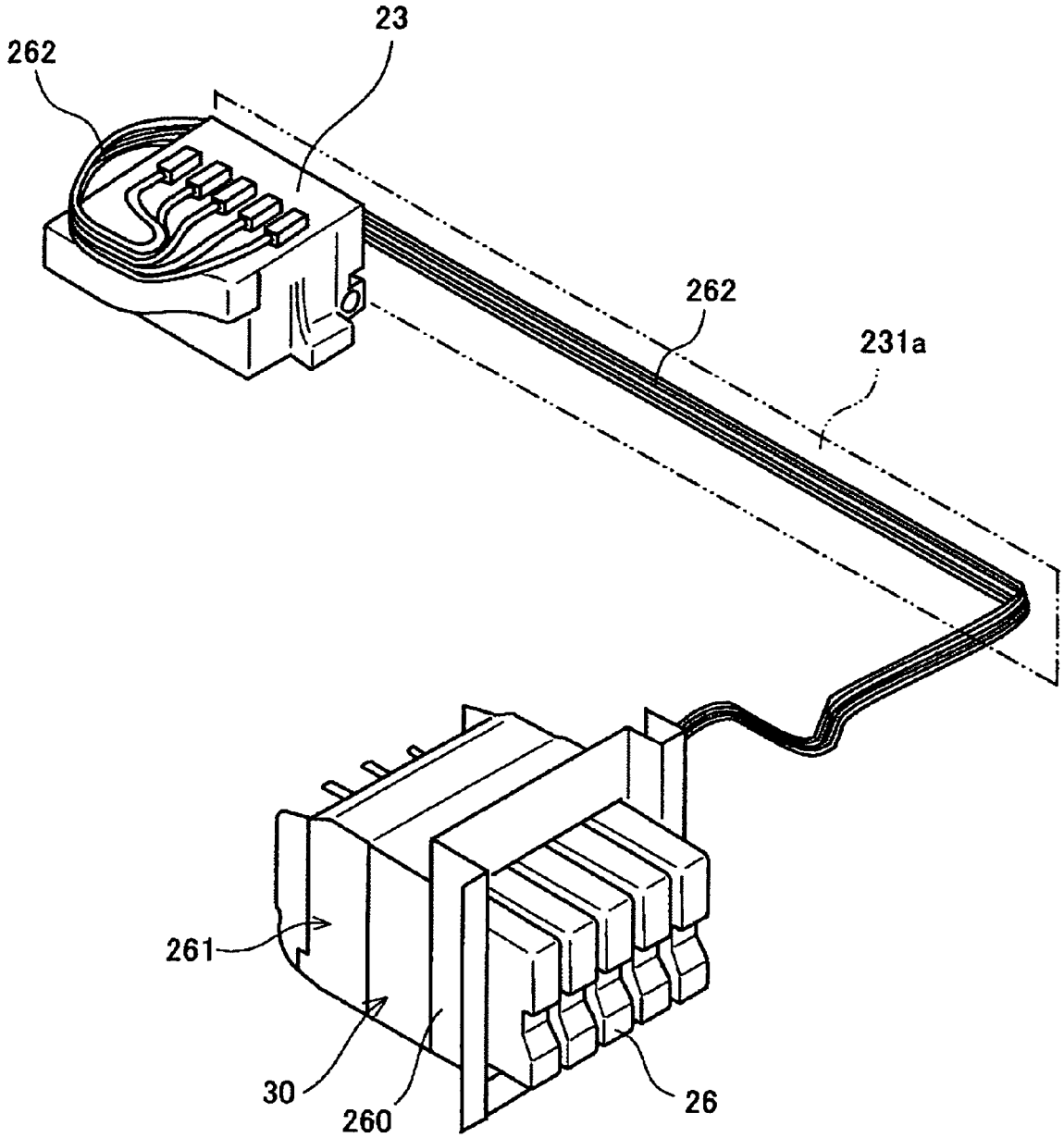
FIG. 9 is a perspective view of an ink supply system of the engine unit.

Because of this, in this image forming apparatus, as shown in FIG. 6 or FIG. 9, the keeping and recovering mechanism 121 of the engine unit 230 is arranged at the rear side of the apparatus main body 1. Under this structure, even in a case of the front operation type, it may be difficult for the operator to hear the noise during the operation the keeping and recovering mechanism 121, so that the noise level experienced by the operator at the time of operating can be reduced.

In addition, in this engine unit 230, as shown in FIG. 8, the main scanning motor 27 of a main scanning driving system is arranged at a front surface side of the apparatus main body 1. In other words, since the main scanning motor 27 is arranged in a direction at which an axial direction is along a direction perpendicular to the main scanning direction, if the size of the frame 231 of the engine unit 230 is made small, the main scanning motor 27 may stick out from the frame 231 of the engine unit 230.

Because of this, by arranging the main scanning motor 27 at a front surface side of the apparatus main body 1 of the engine unit 230, even if the engine unit 230 can be attached and detached against the apparatus main body 1 in the main scanning direction, the space for opening for attaching or detaching the engine unit 230 can be made small.

In other words, in a case where the main scanning motor 27 is arranged at the rear side of the apparatus main body 1 of the engine unit 230, in order to prevent the main scanning motor 27 sticking out from the frame 231 from being obstructed, an opening (space) where the main scanning motor 27 passes from a front side to a rear side of the apparatus main body 1 has to be provided. Furthermore, in this case, it is difficult to attach and detach the engine unit 130.

However, by arranging the main scanning motor 27 at a front surface side of the apparatus main body 1 of the engine unit 230, it is necessary to provide the space, where the main scanning motor 27 passes, only at the front side part, and therefore it is possible to attach and detach the engine unit 130 without any difficulty.

In addition, in this engine unit 230, an encoder wheel is arranged at the front surface side of the apparatus main body 1 so that rotation of the conveyance roller 32 corresponding to the conveyance amount of the recording medium is detected. Because of this, even if a wheel having a large diameter is used so that the resolution of the encoder wheel 137 is improved, it is possible to easily attach and detach the engine unit 230 to and from the apparatus main body 1.

In other words, in a case where the encoder wheel is arranged at a rear side of the apparatus main body 1 of the engine unit 230, it is necessary to provide the opening (space) where the encoder wheel passes from a front side to a rear side of the apparatus main body 1 when the encoder wheel sticks out from the frame 231 and therefore it is difficult to attach and detach the engine unit 230 against the apparatus main body 1.

However, by arranging the encoder wheel 137 at a front side of the apparatus main body 1 of the engine unit 230, it is necessary to provide the space, where the encoder wheel 137 passes, only at the front side part, and therefore it is possible to attach and detach the engine unit 230 without any difficulty.

Furthermore, as discussed above, the image forming apparatus of this embodiment has the sub-tank type structure. Hence, in order to provide a supplemental supply of the ink from the ink cartridge 26 of a side of the apparatus main body 1 to the sub-tank 25 provided at the carriage 23, the ink cartridge arranging part 30 includes a supplying mechanism 261 mounted on the frame 260 configured to charge the ink in the ink cartridge 26. The ink can then be supplied from this supplying mechanism 261 to the sub-tank 25 on the carriage 23 via five tubes 262.

In this case, if an ink supply path from the ink cartridge arranging part 26 to the sub-tank 25 on the carriage 23 via the tube 262 has to be disconnected when the engine unit 230 is attached and detached to and from the apparatus main body 1, dust or fine particles may be easily drawn into the ink supply path and supplying ink may become impossible due to cogging of the ink supply path.

Because of this, in this embodiment, the frame 260 of the ink cartridge arranging part 30 is fixed to the frame 231 of the engine unit 230 so that the ink cartridge 26 and the engine unit 320 are unitized in a body. Under this structure, in a case where the ink supply path is not disconnected unnecessarily when the engine unit 230 is attached and detached to and from the apparatus main body 1, it is possible to prevent the dust or fine particles from getting into the ink supply path.

In addition, in this engine unit 230, as shown in FIG. 8 and FIG. 9, the ink supply tube 262 connecting from the ink cartridge arranging part 30 to the sub-tank 25 of the carriage 23 is provided along a rear plate 231*a* forming the frame 231 of the unit 230, namely a frame member other than in the main scanning area, so that a portion above the conveyance belt 31 of the sub-scanning conveyance part 3 forms an open space.

Under this structure, in a case where jamming occurs on the sub-scanning conveyance part 3, even if the carriage 23 waits at a home position (on the keeping and recovering mechanism 121), the ink supply tube 262 is not on the sub-scanning conveyance part 3, and a jam-clearing process can be easily done.

The present invention is not limited to the above-discussed embodiments, but variations and modifications may be made without departing from the scope of the present invention.

This patent application is based on Japanese Priority Patent Application No. 2005-45709 filed on Feb. 22, 2005, the entire contents of which are hereby incorporated by reference.

What is claimed is:

1. An image forming apparatus, comprising:

an engine unit provided in an apparatus main body including a carriage on which is mounted a recording head configured to jet a liquid drop of recording liquid, and a sub tank provided in or at the carriage together with the recording head and configured to supply liquid to the recording head, the carriage being movable along a front and rear direction of the apparatus main body;

an operation part provided at a front side of the apparatus main body and arranged above the engine unit, the operation part being configured to supply a designated instruction to the apparatus main body and display designated information; and a keeping and recovering mechanism configured to keep an operating state of the recording head of the engine unit, the keeping and recovering mechanism being provided at a rear side of the apparatus main body which is an opposite side of the operation part in the apparatus main body;

an encoder wheel provided at the front side of the apparatus main body and configured to detect a moving amount of the recording medium conveyed in a direction substantially perpendicular to the front and rear direction of the apparatus main body; and a cartridge receiving part arranged at the front side of the apparatus main body, the cartridge receiving part being connected to the sub tank of the engine unit by a liquid supply tube and being configured to detachably install a recording liquid cartridge and to supply recording liquid in the recording liquid cartridge to the sub tank through the liquid supply tube, wherein both of the removal direction of the recording liquid cartridge from the cartridge receiving part and the removal direction of the engine unit from the engine unit receiving part are the direction toward the front side of the apparatus main body.

2. The image forming apparatus as claimed in claim 1, further comprising:

a driving source of a main driving system configured to move the recording head forming the engine unit, the driving source being provided at a front surface side of the apparatus main body.

3. The image forming apparatus as claimed in claim 1, wherein a recording tube is provided at a frame member provided at an area out of a moving area of the carriage, the recording tube being configured to send recording liquid from the cartridge arranging part to the sub-tank.

4. The image forming apparatus as claimed in claim 1, further comprising:

an engine cover which can be opened and closed so that the engine unit is detachably installed in the apparatus main body; and a cartridge cover which can be opened and closed so that an ink cartridge can be exchanged, wherein the engine cover and the cartridge cover are provided separately at the front surface side of the apparatus main body.

5. The image forming apparatus as claimed in claim 1, further comprising:

an ink storage part provided at a front portion of the apparatus main body; and a cover provided at the front surface side of the apparatus main body and configured to be opened and closed so that said recording liquid storage part can be replenished with ink.

6. The image forming apparatus as claimed in claim 1, wherein a recording medium discharge tray is provided above the engine unit, the recording medium, on which the image is formed by the engine unit, is conveyed in the sub direction to the recording medium discharge tray, and a scanner is provided above the recording medium discharge tray, with the recording medium discharge tray being sandwiched by the engine unit and the scanner.

7. The image forming apparatus as claimed in claim 1, wherein the main direction of the recording head is from one of the front side and the rear side of the apparatus main body to the other of the front side and the rear side of the apparatus main body.

8. The image forming apparatus as claimed in claim 1, wherein both of the operation part and the encoder wheel are provided at the front side of the apparatus main body.

9. The image forming apparatus as claimed in claim 1, wherein the operation part is configured for user designation of an instruction to be supplied to the apparatus main body.

10. An image forming apparatus, comprising:

an engine unit provided in an apparatus main body including a carriage on which is mounted a recording head configured to jet a liquid drop of recording liquid, and a sub tank provided in or at the carriage together with the recording head and configured to supply liquid to the recording head, the carriage being movable along a front and rear direction of the apparatus main body;

an operation part provided at a front side of the apparatus main body and arranged above the engine unit, the operation part being configured to supply a designated instruction to the apparatus main body and display designated information; and a keeping and recovering mechanism configured to keep an operating state of the recording head of the engine unit, the keeping and recovering mechanism being provided at a rear side of the apparatus main body which is an opposite side of the operation part in the apparatus main body;

an encoder wheel provided at the front side of the apparatus main body and configured to detect a moving amount of the recording medium conveyed in a direction substantially perpendicular to the front and rear direction of the apparatus main body; and a cartridge receiving part arranged at the front side of the apparatus main body, the cartridge receiving part being connected to the sub tank by a liquid supply tube and being configured to detachably install a recording liquid cartridge and to supply recording liquid in the recording liquid cartridge to the sub tank through the liquid supply tube, wherein both of the longitudinal direction of the engine unit receiving part and the longitudinal direction of the cartridge receiving part in the apparatus main body are arranged substantially parallel to each other along the front and rear direction of the apparatus main body.

11. An image forming apparatus, comprising:

an engine unit provided in an apparatus main body including a carriage on which is mounted a recording head configured to jet a liquid drop of recording liquid, and a sub tank provided in or at the carriage together with the recording head and configured to supply liquid to the recording head, the carnage being movable along a first direction of the apparatus main body;

an engine unit receiving part provided on one side of the apparatus main body in the first direction and configured for the engine unit to be attached to or detached from the one side of the apparatus main body; and a cartridge receiving part arranged at the one side of the apparatus main body, the cartridge receiving part being connected to the sub tank of the engine unit by a liquid supply tube and being configured to detachably install a recording liquid cartridge and to supply recording liquid in the recording liquid cartridge to the sub tank through the liquid supply tube, wherein both of the detaching direction of the recording liquid cartridge from the cartridge receiving part and the detaching direction of the engine unit from the engine unit receiving part are the direction toward the one side of the apparatus main body.

12. An image forming apparatus, comprising:

an engine unit provided in an apparatus main body including a carriage on which is mounted a recording head configured to jet a liquid drop of recording liquid, and a sub tank provided in or at the carriage together with the recording head and configured to supply liquid to the recording head, the carriage being movable along a first direction of the apparatus main body;

an engine unit receiving part provided on one side of the apparatus main body in the first direction and configured for the engine unit to be attached to or detached from the one side of the apparatus main body; and a cartridge receiving part arranged at the one side of the apparatus main body, the cartridge receiving part being connected to a sub tank by a liquid supply tube and being configured to detachably install a recording liquid cartridge and to supply recording liquid in the recording liquid cartridge to the sub tank through the liquid supply tube, wherein both of the longitudinal direction of the engine unit receiving part and the longitudinal direction of the cartridge receiving part in the apparatus main body are arranged substantially parallel to each other along the first direction of the apparatus main body.

* * * * *